US005331126A

United States Patent [19]

Dwyer et al.

[11] Patent Number: 5,331,126

[45] Date of Patent: Jul. 19, 1994

[54] PRESSURE SWITCH APPARATUS FOR MONITORING PRESSURE LEVEL IN AN ENCLOSED CHAMBER AND METHODS OF CALIBRATING SAME AND FOR MAKING A MOVABLE CONTACT ARM FOR USE THEREWITH

[75] Inventors: Daniel Dwyer, Norton, Mass.; Daniel Morin, North Providence, R.I.; Massimo Mazzola, Napoli, Italy; Karl R. Abrahamson, Easton, Mass.

[73] Assignee: Texas Instruments Incorporated, Dallas, Tex.

[21] Appl. No.: 76,041

[22] Filed: Jun. 15, 1993

[51] Int. Cl.[5] ..... H01H 35/34

[52] U.S. Cl. ..... 200/83 P; 73/723; 200/283; 280/736; 338/200

[58] Field of Search ..... 340/626; 307/118, 10.1; 73/717, 723, 725, 861.47; 338/179, 200; 92/5R, 103 M; 280/736, 741; 200/831 R, 831 A, 831 B, 831 W, 831 J, 831 P, 81 R, 61.08, 61.25, 283, 284, 300, 306

[56] References Cited

U.S. PATENT DOCUMENTS

| | | | |
|---|---|---|---|
| 3,723,684 | 3/1973 | Greenwood . | |
| 3,818,764 | 6/1974 | Wagner . | |
| 3,850,039 | 11/1974 | Brakebill . | |
| 4,049,935 | 9/1977 | Gruber . | |
| 4,939,321 | 7/1990 | Tanaka et al. | 200/83 P |
| 5,189,269 | 2/1993 | Stahly | 200/83 P |

*Primary Examiner*—Gerald P. Tolin

*Attorney, Agent, or Firm*—Russell E. Baumann; Richard L. Donaldson; Rene' E. Grossman

[57] ABSTRACT

A low pressure monitor for hybrid air bag systems for vehicles includes a pressure responsive disc 34.6 exposed on one side to a reference pressure chamber 34.11 and on the other side to the pressure in an air bag bottle 40 and positioned adjacent a movable arm 28.10 of an electric switch, The switch includes an electrically conductive sheet having a first portion partially encased in a base 26 of electrically insulative material and being connected to a first terminal 14 and a second portion forming the movable contact arm 28.10 extending from the insulative material and culminating with a portion formed with contact rib 28.14 adapted to be received beneath a laterally extending stationary contact portion 22 of a second terminal 16. Tabs 28.4, 28.6 extend from the sheet out of the insulative material for connection to a resistor 30 mounted on the electrically insulative base and a frangible portion 28.7 of the first portion is severed to place the resistor in series with the electrical contacts, The monitor is disposed in an air bag bottle with the disc 34.6 adapted to snap from one dished configuration to an opposite dished configuration whenever the pressure on the bottle decreases to a selected level, The movement of the snapping of the disc is transferred to the movable arm 28.10 separating the contact rib 28.14 from the stationary contact portion 22 opening the circuit,

7 Claims, 3 Drawing Sheets

PRESSURE SWITCH APPARATUS FOR MONITORING PRESSURE LEVEL IN AN ENCLOSED CHAMBER AND METHODS OF CALIBRATING SAME AND FOR MAKING A MOVABLE CONTACT ARM FOR USE THEREWITH

BACKGROUND OF THE INVENTION

This invention relates to apparatus for monitoring gas pressure levels in an enclosed chamber and more specifically to apparatus for monitoring a pressurized gas used in hybrid air bag systems for motor vehicles.

The use of air bags for drivers as well as passengers in motor vehicles is becoming more and more widespread. Earlier versions of air bag systems made use of pyrotechnic inflators in which a rapid oxidation of sodium azide causes the air bags to inflate in a very short period of time, i.e., approximately 40 to 45 milliseconds. Sodium azide, however, is hazardous in processing. The material is toxic to unprotected workers and is a powerful, unstable explosive during processing.

As a result, a modified air bag inflator is becoming more common. In the modified system, known as a hybrid inflator, a pressurized gas, typically argon, an inert gas, is used in combination with a smaller amount of less hazardous solid propellant to inflate the air bag. Although hybrid systems take slightly longer to inflate a bag, e.g., 50 to 55 milliseconds, and require a heavier steel housing rather than aluminum used for the pyrotechnic versions, substituting argon gas for a solid propellant substantially lowers the cost of the inflator system and is less hazardous to process. In addition, the cost is reduced because the hybrid inflator does not require a sophisticated filtering system which is required in the pyrotechnic version.

An air bag module comprises an inflator, a metal housing and an inflatable bag. The hybrid version also requires a separate electronic circuit including a sensor to monitor the bottle pressure for the stored gas. That is, it is necessary to be able to determine that the pressure of the stored gas is above a selected level to ensure effective deployment of the air bag when called for.

A pressure switch for use as a sensor in a hybrid air bag system is shown and described in U.S. Pat. No. 4,049,935. The switch is placed within a pressure chamber of an air bag system to monitor the pressure level therein and to provide a signal if the pressure in the chamber decreases below a certain level. The switch employs a diaphragm movable between opposite reinforcement sections. Movement of the diaphragm caused by a pressure change pushes a contact arm against the bias of a spring, through a pin, to engage a stationary contact and complete an electric circuit. As noted in the patent the reinforcement sections are spaced apart on the central axis about 0.035 inches with the diaphragm moving between the two extremities. This distance provides sufficient travel to allow the use of a spring and movable contact arm having sufficient stiffness relative to the diaphragm force to avoid problems caused by vibration. That is, the components of the switch must be chosen so that reliable operation is obtained in the event that the pressure in the chamber decreases below the specified level while at the same time avoiding nuisance tripping or chatter caused by the components of the system vibrating at their natural frequency.

In air bag systems currently being used space occupied by the system is at a premium, particularly with respect to the driver's side. As a result, the space available for the sensor switch has been decreased so that it is very difficult to provide a switch of the type shown in the patent which, due to the required smaller diaphragm and its concomitant reduced travel, has sufficient stiffness to avoid such problems caused by vibration.

It is an object of the present invention to provide a sensor switch which is sufficiently small in size to be useful as an air bag sensor switch. Another object is the provision of a switch which is inexpensive, long lasting and easily calibratable. Other objects, features and advantages of the invention will be apparent from the following detailed disclosure, taken in conjunction with the accompanying drawings, wherein like reference numerals refer to like parts.

SUMMARY OF THE INVENTION

Briefly, in accordance with the invention, pressure switch apparatus for monitoring the pressure level in an enclosed chamber comprises a movable contact arm assembly in which an electrically conductive sheet member has a first end formed with first and second legs extending from a central portion, the legs encased in respective first and second legs of a U-shaped, electrically insulative base. A first tab is connected to the central portion and through a frangible portion to a second tab which in turn is connected to a support section embedded in the insulative material of the base. A strip of the electrically conductive sheet extends out of the insulative material and is bent to extend laterally in a selected direction through a widened intermediate portion to a free distal end with a contact rib extending from the widened portion to the free distal end. First and second terminals extend through an electrically insulative header with the central portion of the electrically conductive sheet connected to the first terminal. The second terminal has a free distal end extending laterally approximately 90° from an imaginary line extending between the two terminals. The distal free end of the terminal serves as a stationary contact with the free distal end of the conductive sheet received under the free distal end of the second terminal and biased thereagainst. A resistor is preferably connected to the two tabs and the frangible portion is severed leaving a current path extending from the first terminal through the resistor to the contact platform and to the second terminal. The switch is circumscribed by an open ended sleeve mounted on the header with a pressure sensing assembly slidably received in the sleeve over the widened intermediate portion of the electrically conductive member. The pressure sensing assembly comprises a cup shaped housing closed by a pressure responsive disc movable between oppositely dished concave, convex configurations. When the disc moves from an upwardly convex configuration to an upwardly concave configuration motion from the disc is transferred to the intermediate portion of the electrically conductive member forcing the contact platform away from the free distal end of the second terminal thereby opening the circuit. The sleeve is vented to allow equalization of pressure on the side of the disc facing the switch. The cup shaped housing is provided with an orifice to allow evacuation and infilling with a selected gas such as a mixture of argon and helium and is thereafter sealed and serves as a gas reference chamber. The apparatus is calibrated by taking the pressure sensing assembly, after the cup shaped housing is sealed, and sliding it into the sleeve against the electrically conductive member until electrical engagement between the conductive member and the second terminal is broken and then advancing the pressure sensing assembly approximately half of the distance the center of the disc travels in its snapping motion. The sensor assembly is then fixed to the sleeve, as by welding, at that position. The apparatus is hermetically attached to a wall within an air bag bottle and, when the terminals are connected to a suitable voltage source, the apparatus will monitor the pressure in the air bag bottle. If the pressure in the bottle should decrease to a selected level indicating inadequate inflator bottle pressure the disc will snap to its upwardly concave configuration and open the circuit. Placement of the resistor in series with the switch contacts provides the capability of obtaining selected diagnostic information relating to the system.

DESCRIPTION OF THE PREFERRED EMBODIMENTS

Figure 1:
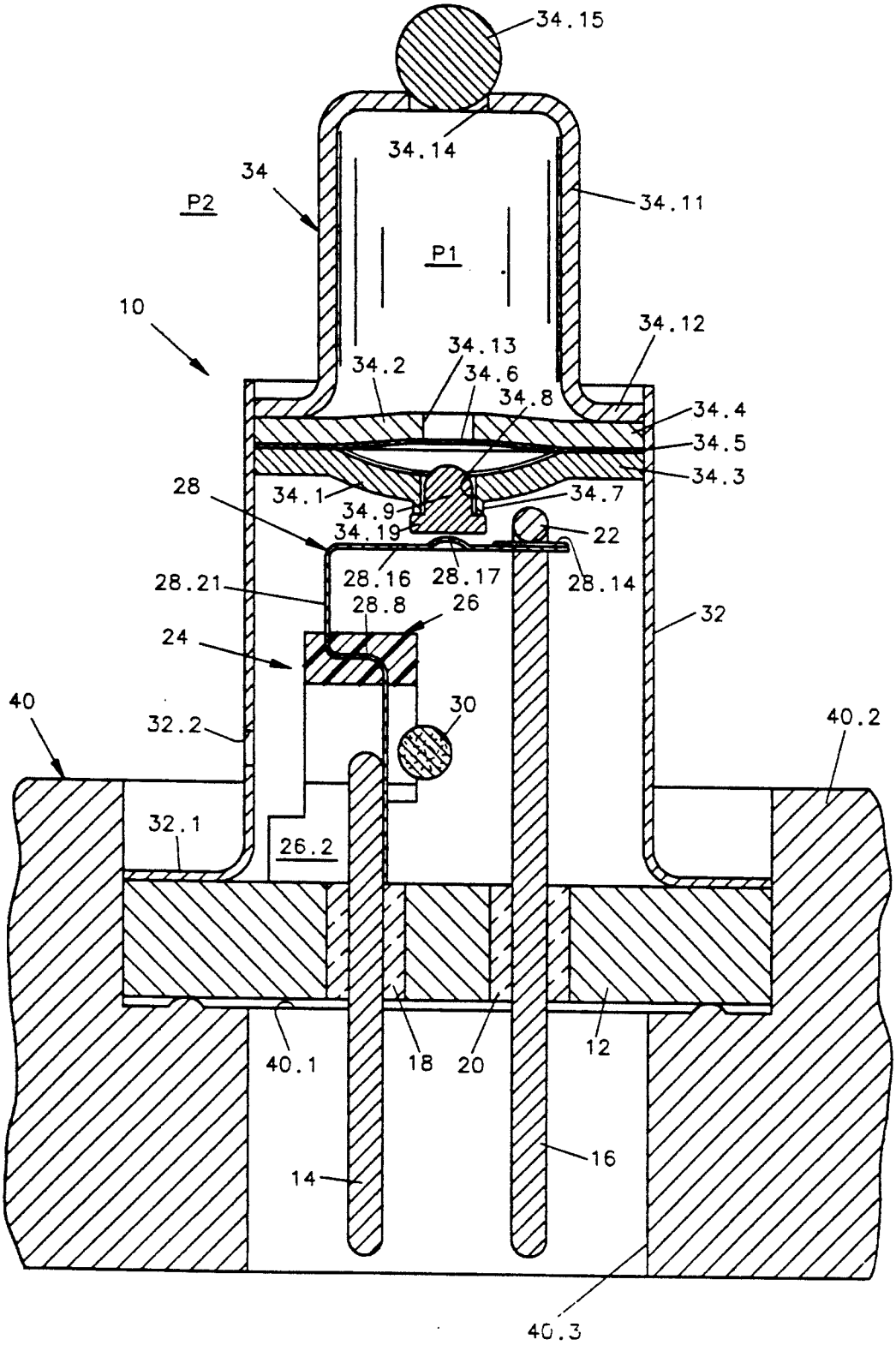
FIG. 1 is a cross sectional view of an air bag sensor switch assembly hermetically mounted on the wall of a pressure bottle.

Turning now to the drawings, numeral 10 designates a sensor switch assembly made in accordance with the invention. The switch assembly comprises a header 12 formed of suitable weldable material such as steel having first and second spaced electrically conductive terminals 14, 16 mounted in apertures formed in the header and electrically separated therefrom and from one another by suitable electrically insulative material such as glass 18, 20 respectively to form a hermetic seal. Terminals 14, 16, as shown, are formed from cylindrical stock; however, the cross sectional configuration is a matter of choice. Terminal 16 has a free distal end 22 bent over to form a laterally extending leg extending approximately 90° to an imaginary line drawn between the terminals for a purpose to be described below.

Figure 3:
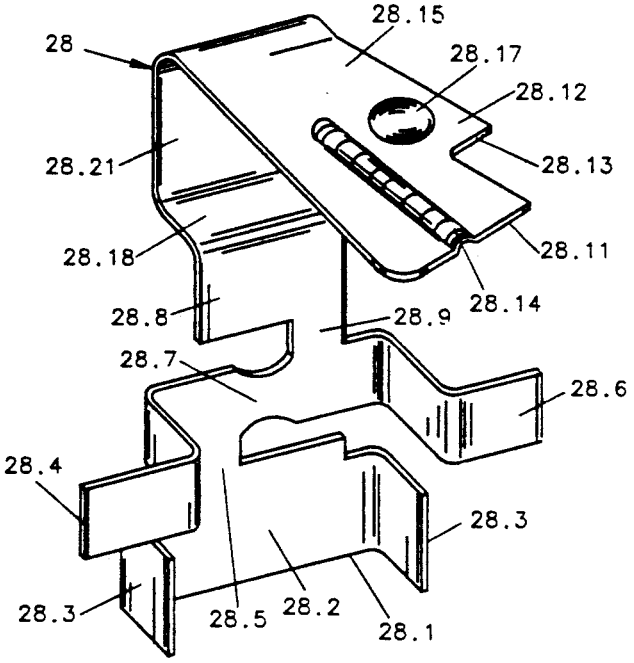
FIG. 3 is an enlarged perspective view of the movable contact arm prior to being inserted in the movable contact assembly.

A movable arm assembly 24 comprises a base 26 formed of suitable electrically insulative material, preferably a moldable plastic material. An electrically conductive member 28, best seen in FIG. 3, is mounted on base 26 as by insert molding a portion of the member within the base. Member 28 is generally elongated and formed of electrically conductive material having good spring characteristics such as AISI type 301 or 302 stainless steel. Member 28 has a first end 28.1 preferably formed into a U-shaped configuration having a central portion 28.2 between two leg portions 28.3, the leg portions adapted to be encased in respective leg portions 26.2 of base 26. Central portion 28.2 is connected, adjacent one leg 28.3, to laterally extending tab 28.4 through arm 28.5, A second tab 28.6 extends laterally from tab 28.4 in an opposite direction through a narrowed or necked frangible portion 28.7. Tab 28.6 is connected to a support portion 28.8 through arm 28.9. A strip forming a movable contact arm portion 28.21 extends from support portion 28.8 out to a second end 28.11 of member 28 through a widened intermediate length portion 28.12 which is cut-away at 28.13 to provide clearance for terminal 16.

An upwardly extending (as seen in FIG. 3) contact rib 28.14 extends generally along the side of conductive member 28 opposite to the side having the cut-away from intermediate length portion 28.12 to distal end 28.11 and is preferably provided on its upper surface with a hard gold plate over a nickel strike to provide a low resistance electrical connecting point. Contact rib 28.14 additionally serves to stiffen the outer portion of conductive member 28. An upwardly extending (as seen in FIG. 3) dimple 28.17 is formed centrally in the intermediate length portion which cooperates with pin 34.9, to be discussed below, to transfer motion to movable contact arm portion 28.21.

Tabs 28.4 and 28.6 preferably are bent to lie in a plane spaced from central portion 28.2 of first end 28.1, as seen in FIG. 3, while support portion 28.8 has a downwardly extending portion 28.18 connecting it with movable arm portion 28.10.

As stated above, member 28 is insert molded in base 26. The base is generally U-shaped having a bight section 26.1 between first and second downwardly depending base legs 26.2. Electrically conductive central portion 28.2 and frangible portion 28.7 extend between base legs 26.2 below bight portion 26.1 of base 26. Once member 28 is encased in base 26 frangible portion 28.7 is severed to electrically isolate tab 28.4 from tab 28.6 for a purpose to be described below.

Figure 2:
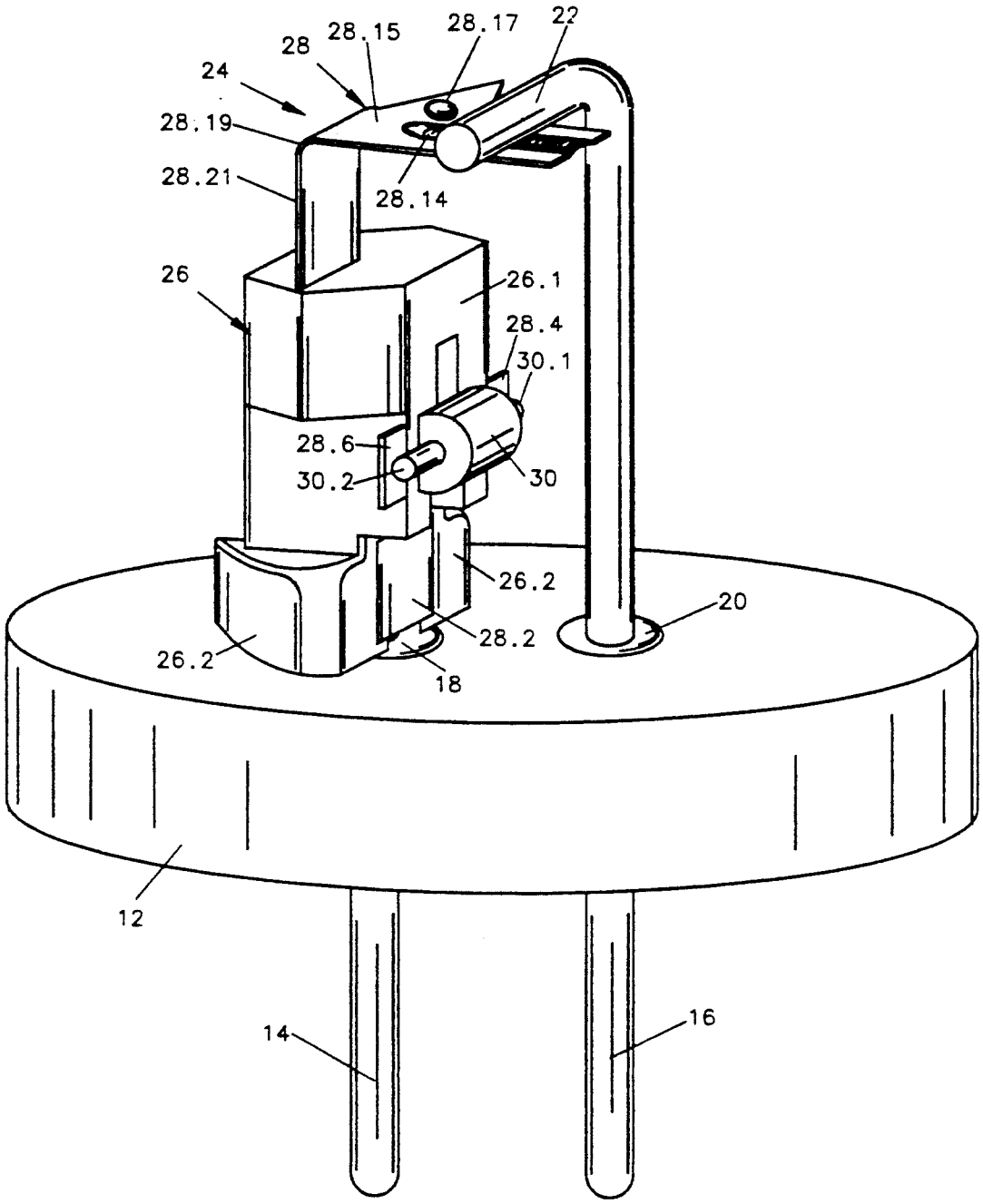
FIG. 2 is an enlarged perspective view of the header of the switch assembly including the stationary and movable contact assemblies.

In order to provide diagnostic capability to the switch system preferably a resistor 30, seen in FIGS. 1 and 2, is attached in a conventional manner, as by soldering or welding, to tabs 28.4, 28.6 through leads 30.1, 30.2 respectively.

Figure 4:
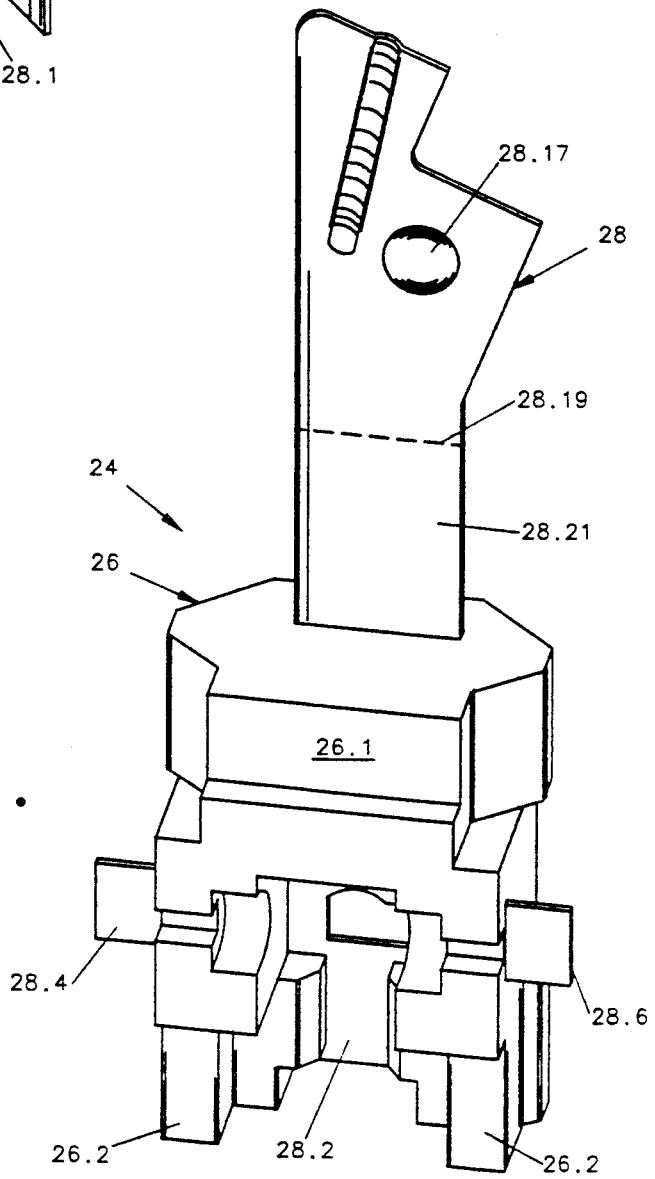
FIG. 4 is an enlarged perspective view of the movable contact assembly shown essentially from the right side with reference to FIG. 1 and before the arm is bent into its final configuration.

Movable contact arm portion 28.21 is permanently bent at dashed line 28.19 (FIG. 4) so that the remaining portion 28.15 of member 28 extends generally perpendicular to that portion of arm 28.21 extending from base 26.

The movable arm assembly 24 is placed on header 12 with terminal 14 received between legs 26.2 and with portion 28.15 angularly removed from terminal 16. The assembly is then pivoted so that contact rib 28.14 is received below distal end 22 and central portion 28.2 is electrically and physically connected to terminal 14 in a conventional manner as by welding.

A current path extends from terminal 14 to central portion 28.2, arm 28.5 to tab 28.4, resistor 30, tab 28.6, arm 28.9, movable contact portion 28.10 and, in its normal position, movable contact rib 28.14 in engagement with leg 22 of terminal 16.

Arm portion 28.19, as mentioned above, is bent at 28.20, to provide a selected contact force between leg 22 and movable contact 28.14 when in its normal at rest position. By way of example, a contact force of 50 grams is found to be satisfactory.

A generally cylindrical sleeve 32 formed of suitable material such as steel, is attached to header 12 by any conventional means such as welding flange 32.1, formed at one end of sleeve 32, to the header. A vent aperture 32.2 is formed through the wall of sleeve 32 for a purpose to be described below.

A pressure sensor assembly 34 is formed of first and second generally circular support plates 34.1 and 34.2 each having an outer flange portion 34.3, 34.4 respectively, capturing therebetween the outer flange 34.5 of a snap acting disc 34.6. Support plates 34.2, 34.1 each has a central portion dished in opposite concave, convex configuration to allow the central portion of disc 34.6 to snap between a first normal, at rest, upwardly concave configuration, shown in dashed lines in FIG. 1, and a second upwardly convex configuration when subjected to a selected pressure or force on the lower side of the disc as seen in the figure. Support plate 34.1 is formed with a hub 34.7 through which a bore 34.8 is formed. A motion transfer pin 34.9 is loosely received in bore 34.8 allowing equalization of pressure on both sides of support plate 34.1. Pin 34.9 is formed with a radial flange 34.19 extending beyond the diameter of bore 34.8 to serve to limit travel of pin 34.9 into bore 34.8.

A reference pressure chamber comprising a cup shaped housing member 34.11 of steel or other suitable material having an outwardly extending flange 34.12 at one end thereof matching that of flanges 34.4, 34.5 is hermetically attached thereto as by welding around its periphery. An aperture 34.13 is formed in support plate 34.2 to allow equalization of pressure on both sides of support plate 34.2. An orifice 34.14 is formed at another end of housing member 34.11 permitting evacuating of and infilling the reference chamber with a selected atmosphere and pressure such as argon and helium at a pressure P1. The chamber is then sealed with a suitable seal such as by welding a spherical seal member 34.15 to the housing.

The switch system is then calibrated by sliding the pressure sensor assembly 34 downwardly into sleeve 32 with disc 34.6 in the dashed line position, moving movable contact arm 28.10 downwardly against its bias to separate movable contact rib 28.14 from stationary contact leg 22. The disc, having a central movable portion with a diameter of approximately 0.5 inches, has a travel at its center of approximately 0.016 inches when it snaps between its opposite configurations. After the contacts separate the pressure sensor assembly is advanced approximately half the distance of the disc travel, i.e. approximately 0.008 inches and then the sensor assembly is fixed to sleeve 32 at that location as by welding thereto.

The system is then ready to be inserted in an air bag pressure bottle 40 as by placing header 12 on a seat 40.1 formed in the wall 40.2 of a bottle formed of conventional material such as steel and is hermetically attached to seat 40.1 as by welding around the periphery of the header. A centrally disposed bore 40.3 communicating with seat 40 provides access to terminals 14, 16 for connection to a suitable circuit for monitoring the status of the system.

The switch system described above is normally closed and by placing resistor 30 in series with the switch and by impressing a voltage across the terminals certain information about the status of the system can be obtained. Once the bottle 40 has been pressurized to a selected pressure level, i.e. P2, this pressure will cause disc 34.6 to snap to its solid line position allowing movable contact 28.14 to engage leg 22 thereby closing the circuit between terminals 14, 16. As long as the pressure P2 in the bottle remains above a threshold level then a voltage across the terminals will be equal to the current flowing through resistor 30 times the resistance of resistor 30. If, for some reason the pressure in bottle 40 decreases below that threshold level, as by gradual leakage out of bottle 40, then disc 34.6 will snap to its dashed line configuration forcing movable contacts to separate from leg 22 thereby opening the circuit so that the voltage measured across the terminals will be the impressed voltage. A reading of the impressed voltage will also be obtained in the event that a connector to the terminals becomes detached.

The pressure switch system made in accordance with the invention is provided with ambient temperature compensation by means of using essentially the same gas in the reference chamber as in the pressurized bottle. Although it is generally preferred to have a normally closed switch since such a switch obviates the potential problems of a gradual build-up of oxides or the like on the contact surfaces which could interfere with making electrical engagement when the disc snaps in a normally open switch; it will be appreciated that nevertheless a normally open switch could be provided by placing contact 28.14 above leg 22.

The switch system made in accordance with the invention, having the movable contact captured below leg 22 and provided with a suitable contact closing force, has enhanced insensitivity to vibration of the type to which it is exposed in a vehicular environment even though the disc travel is only in the order of 0.016 inches, less than half that of the switch described in U.S. Pat. No. 4,049,935 referenced supra.

Although the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. Pressure responsive electrical switch apparatus for monitoring the pressure level in an enclosed chamber comprising a header and first and second generally elongated terminals, each terminal having a longitudinal axis, the header mounting the terminals electrically isolated from each other and from the header, the second terminal having a distal free end extending laterally generally 90° from the longitudinal axis of the second terminal, a movable contact arm assembly having a generally U-shaped base composed of electrically insulative material comprising first and second legs extending downwardly from a bight portion, an electrically conductive member having a first portion with a first end formed with first and second legs extending from a central portion, the first and second legs of the electrically conductive member encased in respective first and second legs of the U-shaped base, the central portion extending between the first and second legs of the U-shaped base and being electrically connected to the first terminal, the electrically conductive member having a second portion with a second end formed with a movable contact received under and biased toward the distal free end of the second terminal, the electrically conductive member having an intermediate portion supported by and extending from the bight portion of the base, and a pressure sensor assembly comprising an open ended sleeve extending upwardly from the header, a pressure reference chamber having an open end, a pressure responsive disc movable between first and second oppositely dished configurations closing the open end of the pressure reference chamber and received in the open ended sleeve, the sleeve being formed by a wall having a vent opening therethrough, the disc being adapted to transfer motion to the intermediate portion of the electrically conductive member when moving from one of the configurations to the other configuration to move the movable contact away from the distal free end of the second terminal.

2. Pressure responsive electrical switch apparatus according to claim 1 in which a first tab extends from the first portion of the electrically conductive member outwardly from the first leg of the base and a second tab extends from the second portion of the electrically conductive member outwardly from the second leg of the base and a resistor having first and second leads is mounted on the base with the first and second leads connected respectively to the first and second tabs.

3. Pressure responsive electrical switch apparatus according to claim 1 in which the intermediate portion of the electrically conductive member is formed with a widened portion to accommodate a motion transfer dimple and a contact rib forming the movable contact each formed in the intermediate portion.

4. Pressure responsive electrical switch apparatus according to claim 1 in which the second end of the electrically conductive member has a cut-away portion adjacent the movable contact to provide electrical clearance with the second terminal.

5. Pressure responsive electrical switch apparatus for monitoring the pressure level in an enclosed chamber comprising a header and first and second generally elongated terminals, each terminal having a longitudinal axis, the header mounting the terminals electrically isolated from each other and from the header, the second terminal having a distal free end extending laterally approximately 90° from the longitudinal axis of the second terminal, a movable contact arm assembly having a base composed of electrically insulative material, an electrically conductive member having a portion thereof encased in the base and having a central portion extending out of the base, the central portion being electrically connected to the first terminal, the electrically conductive member having another portion with an end formed with a movable contact received under and biased toward the distal free end of the second terminal, the electrically conductive member having an intermediate portion supported by and extending from the base, and a pressure sensor assembly comprising an open ended sleeve extending upwardly from the header, a pressure reference chamber having an open end, a pressure responsive disc movable between first and second oppositely dished configurations closing the open end of the pressure reference chamber and received in the open ended sleeve, the sleeve being formed by a wall having a vent opening therethrough, the disc being adapted to transfer motion to the intermediate portion of the electrically conductive member when moving from one of the configurations to the other configuration to move the movable contact away from the distal free end of the second terminal.

6. Pressure responsive electrical switch apparatus according to claim 5 in which a first tab extends from the electrically conductive member outwardly from the base and a second tab extends from the electrically conductive member outwardly from the base and a resistor having first and second leads is mounted on the base with the first and second leads connected respectively to the first and second tabs.

7. Pressure responsive electrical switch apparatus according to claim 5 in which the intermediate portion of the electrically conductive member is formed with a generally longitudinally extending rib to serve as the movable contact and to stiffen the intermediate portion.

* * * * *